US009277324B2

(12) United States Patent
Azmi

(10) Patent No.: US 9,277,324 B2
(45) Date of Patent: Mar. 1, 2016

(54) THREE PART MEMBRANE SPEAKER

(71) Applicant: Apple Inc., Cupertino, CA (US)

(72) Inventor: Yacine Azmi, San Jose, CA (US)

(73) Assignee: Apple Inc., Cupertino, CA (US)

( * ) Notice: Subject to any disclaimer, the term of this patent is extended or adjusted under 35 U.S.C. 154(b) by 149 days.

(21) Appl. No.: 14/135,337

(22) Filed: Dec. 19, 2013

(65) Prior Publication Data

US 2015/0181341 A1 Jun. 25, 2015

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 7/18*** | (2006.01) |
| ***H04R 7/04*** | (2006.01) |
| ***H04R 1/24*** | (2006.01) |
| ***H04R 7/12*** | (2006.01) |
| *H04R 7/20* | (2006.01) |

(52) U.S. Cl.

CPC .. *H04R 7/18* (2013.01); *H04R 1/24* (2013.01); *H04R 7/04* (2013.01); *H04R 7/125* (2013.01); *H04R 7/20* (2013.01); *H04R 2207/021* (2013.01); *H04R 2231/003* (2013.01); *H04R 2307/025* (2013.01); *H04R 2307/027* (2013.01)

(58) Field of Classification Search

CPC ..... H04R 7/122; H04R 7/127; H04R 7/00; H04R 7/02; H04R 7/12; H04R 7/16; H04R 7/18; H04R 7/20; H04R 7/22; H04R 7/24; H04R 7/26

USPC ..... 181/165

See application file for complete search history.

(56) References Cited

U.S. PATENT DOCUMENTS

| | | | | |
|---|---|---|---|---|
| 7,185,735 | B2 | 3/2007 | Sahyoun | |
| 8,467,557 | B2 | 6/2013 | Miller et al. | |
| 2006/0088184 | A1 | 4/2006 | Ohashi et al. | |
| 2013/0058519 | A1 | 3/2013 | Wilk | |
| 2013/0070953 | A1 * | 3/2013 | Dodd et al. | 381/398 |
| 2013/0195311 | A1 | 8/2013 | Sahyoun | |

FOREIGN PATENT DOCUMENTS

| | | |
|---|---|---|
| JP | 2003348691 | 12/2003 |
| WO | WO-2011135291 | 11/2011 |

OTHER PUBLICATIONS

Korean Office Action dated Nov. 2, 2015, Korean Appln. No. 10-2014-0184372 with English-language translation, 7 pages.

* cited by examiner

*Primary Examiner* — Matthew Eason

(74) *Attorney, Agent, or Firm* — Blakely, Sokoloff, Taylor & Zafman LLP

(57) ABSTRACT

A speaker assembly membrane including a sound radiating surface (SRS) having a first material; a substantially planar SRS ring positioned concentrically outward from the SRS and having a second material; and a suspension member positioned concentrically outward from the SRS ring and having a third material. The second material is stiffer than the first material and the third material to locally stiffen an area surrounding the SRS and improve a breaking mode frequency of the membrane. In another embodiment, the speaker assembly membrane may include a diaphragm having a first material density; a substantially planar stiffening ring extending radially outward from an outer edge of the diaphragm and having a second material density; and a suspension member extending radially outward from an outer edge of the stiffening ring and having a third material density. The second material density is greater than the first material density and the third material density.

19 Claims, 6 Drawing Sheets

THREE PART MEMBRANE SPEAKER

FIELD

An embodiment of the invention is directed to a three part membrane having a stiffening region to improve acoustic performance of a driver within which the membrane may be implemented. Other embodiments are also described and claimed.

BACKGROUND

Whether listening to an MP3 player while traveling, or to a high-fidelity stereo system at home, consumers are increasingly choosing intra-canal and intra-concha earphones for their listening pleasure. Both types of electro-acoustic transducer devices have a relatively low profile housing that contains a receiver or driver (an earpiece speaker). The low profile housing provides convenience for the wearer, while also providing very good sound quality.

These devices, however, do not have sufficient space to house high fidelity speakers. This is also true for portable personal computers such as laptop, notebook, and tablet computers, and, to a lesser extent, desktop personal computers with built-in speakers. Such devices typically require speaker enclosures or boxes that have a relatively low rise (i.e. height as defined along the z-axis) and small back volume, as compared to, for instance, stand alone high fidelity speakers and dedicated digital music systems for handheld media players.

The drivers (earpiece speakers) for such devices therefore typically use a low profile diaphragm assembly, which is composed of two parts. Namely, a sound radiating surface (SRS) and a suspension member. The SRS vibrates axially thereby creating pressure waves outside the driver enclosure. The suspension surrounds and suspends the SRS within the enclosure and allows it to vibrate axially. Each of these moving parts, however, have natural structural resonances that can be excited at certain frequencies, which are typically different from one another. As a result, at certain frequencies (i.e. the breaking mode frequency) the SRS and the suspension member move out of phase with one another. Such out of phase movements, such as for example, when the suspension member moves to a greater degree than the SRS, result in an undesirable sound pressure output (i.e. drop in pressure) at the breaking mode frequency.

SUMMARY

An embodiment of the invention is a three part speaker assembly membrane having an improved and/or increased breaking mode frequency. The speaker assembly membrane may include a sound radiating surface (SRS) having a first material. The assembly may further include a substantially planar SRS ring positioned concentrically outward from the SRS and having a second material. In addition, a suspension member is positioned concentrically outward from the SRS ring and having a third material. In one embodiment, the second material is stiffer than the first material and the third material so as to locally stiffen an area surrounding the SRS and improve a breaking mode frequency of the membrane.

In another embodiment, the speaker assembly membrane may include a diaphragm having a first material density. The speaker assembly may further include a substantially planar stiffening ring extending radially outward from an outer edge of the diaphragm and having a second material density. In addition, a suspension member extends radially outward from an outer edge of the stiffening ring and has a third material density. In one embodiment the second material density is greater than the first material density and the third material density so as to locally stiffen an area between the diaphragm and the suspension member and increase a breaking mode frequency of the membrane.

Another embodiment of the invention includes a driver having a frame and a membrane assembly for radiating sound. The membrane assembly may include a sound radiating surface (SRS), an SRS ring positioned around an outer edge of the SRS, and a suspension member positioned around an outer edge of the SRS ring. The SRS ring stiffens an area between the outer edge of the SRS and the suspension member. The driver may further include a voice coil connected to a face of the SRS ring.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1:
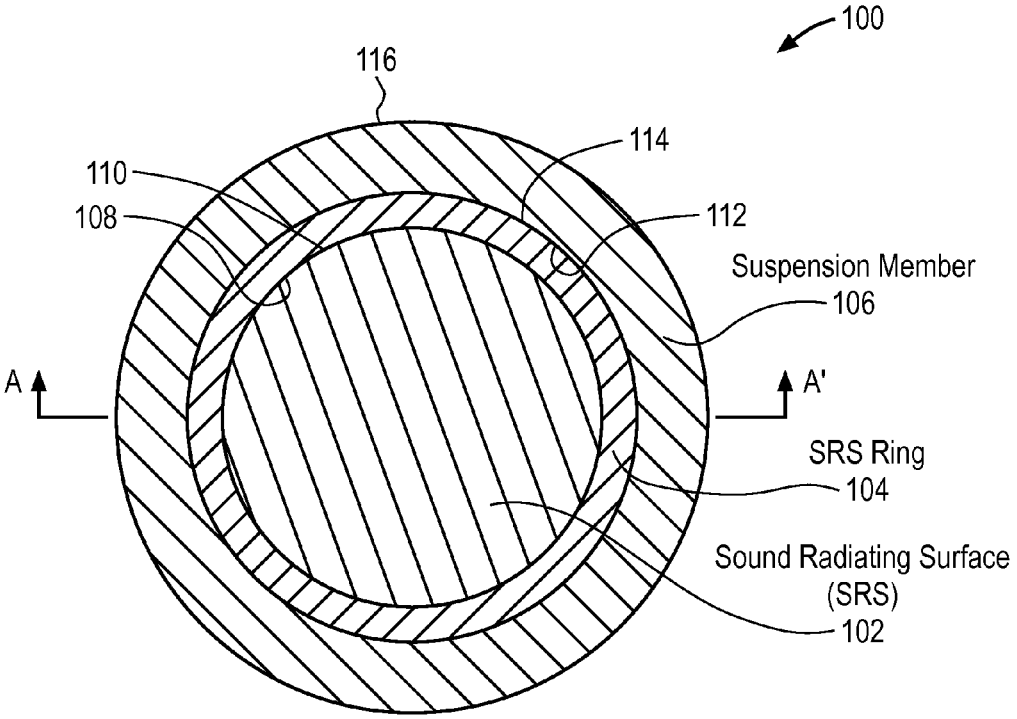
FIG. 1 illustrates a top plan view of one embodiment of a membrane.

FIG. 1 illustrates a top plan view of one embodiment of a membrane. In one embodiment, membrane 100 is dimensioned to generate sound waves when integrated within a driver. The driver may be, for example, an electric-to-acoustic transducer having membrane 100 and circuitry configured to produce a sound in response to an electrical audio signal input (e.g., a loudspeaker). In some embodiments, membrane 100 is configured for use within a 10 mm to 20 mm driver.

Membrane 100 may be a three part membrane which is configured to improve and/or increase a breaking mode frequency of the membrane and/or driver within which it is implemented. Representatively, in one embodiment, membrane 100 includes a sound radiating surface (SRS) 102, an SRS ring 104 and a suspension member 106. The SRS 102 may form a center portion of membrane 100 and each of SRS ring 104 and suspension member 106 may be positioned concentrically outward from SRS 102. Said another way, each of SRS ring 104 and suspension member 106 are positioned radially outward from SRS 102. Representatively, in one embodiment, SRS 102 may be a relatively low profile (i.e. small z-height) dome shaped structure having outer edge 108. SRS ring 104 may be a ring shaped structure dimensioned to surround SRS 102. An inner edge 110 of SRS ring 104 may attach to the outer edge 108 of SRS 102. Suspension member 106 may further be a substantially ring shaped structure dimensioned to surround SRS 102 and SRS ring 104. In some embodiments, each of the SRS 102, SRS ring 104 and all, or a portion of, suspension member 106 may have sound radiating properties. An inner edge 114 of suspension member 106 may be attached to outer edge 112 of SRS ring 104. In addition, an outer edge 116 of suspension member 106 may be attached to the driver frame (not shown) in order to suspend SRS 102 within the frame. In this aspect, each of SRS ring 104 and suspension member 106 extend radially outward from outer edge 108 of SRS 102 such that they are within substantially the same horizontal plane and therefore do not substantially increase a z-height of the assembly. In addition, SRS ring 104 is between the outer edge 108 of SRS 102 and the inner edge 114 of suspension member 106 such that SRS 102 and suspension member 106 are spaced a distance from one another and do not contact one another. In other words, they are separated by SRS ring 104.

SRS ring 104 may be made of any material suitable for locally stiffening an area around SRS 102, more specifically an area between SRS 102 and suspension member 106 which is within substantially the same horizontal plane of SRS 102 so as not to increase a z-height of the assembly. Representatively, as previously discussed, at certain frequencies, typical speaker diaphragms may experience a breaking mode in which the diaphragm components are out of phase with one another and therefore a decrease in sound pressure output from the driver at the breaking mode frequency may occur. By stiffening the area around SRS 102, and between SRS 102 and suspension member 106, using SRS ring 104, this breaking mode frequency can be increased to a frequency which is above the working range of the driver. Since the breaking mode frequency is above the working range of the driver, any undesirable impact in sound output from the driver due to the breaking mode will go substantially unnoticed by the user. For example, in some embodiments where the working range of the driver is from about 0.02 kHz to about 20 kHz, or from about 4 kHz to about 14 kHz, the SRS ring 104 is configured to increase the breaking mode frequency to a frequency greater than about 4 kHz, for example, greater than about 14 kHz, or for example, a breaking mode frequency greater than 20 kHz. For example, the breaking mode frequency may be increased to within a range of from about 4 kHz to about 25 kHz, for example, from about 10 kHz to about 20 kHz, or from about 14 kHz to about 16 kHz.

Said another way, the desired increase or improvement in breaking mode frequency can be quantified by a ratio between the breaking mode frequency and the diameter of the membrane. Representatively, where f is the breaking mode frequency and D is the overall diameter of the surface that is expected to contribute to the transduction process, for example, membrane 100, the ratio may be f/D and an improvement or increase in breaking mode frequency may be present where f/D is at least 0.2e6 [1/(s*m)] or at least 1e6 [1/(s*m)]. It is noted that the breaking mode frequency and/or f/D values described herein are considered an improvement and/or increase in breaking mode frequency because they are an improvement and/or increase with respect to a breaking mode frequency, and/or f/D range, which would be found in a membrane without localized stiffening using SRS ring 104.

Local stiffening of the area around SRS 102 may be accomplished by making SRS ring 104 of a material having a greater stiffness than the material used to make SRS 102 and/or suspension member 106. In still further embodiments, local stiffening may be accomplished by making SRS ring 104 of a material having a greater density than the material used to make SRS 102 and/or suspension member 106. For example, SRS 102 may be made of a first material, SRS ring 104 may be made of a second material and suspension member 106 may be made of a third material. In one embodiment, each of the first material, the second material and the third material may be different materials having different stiffnesses and/or different densities.

In one embodiment, the first material of SRS 102 may be any material capable of forming a relatively stiff axially vibratable membrane. It is further important that the SRS 102 be made of a relatively light and/or relatively low density material so as not to substantially increase a mass of the SRS 102 and therefore impact a desired high frequency response of the membrane 100. Representatively, a suitable material for SRS 102 may include, but is not limited to, a polyester material. A suitable polyester material may include, but is not limited to, polyethylene naphthalate (PEN). For example, in one embodiment, the SRS 102 may be an integrally formed dome shaped structure made of a PEN thermofoil.

A suitable second material for SRS ring 104 may include, but is not limited to, a material having a greater stiffness and/or density than the material used to make SRS 102. For example, SRS ring 104 may be made of a material which is at least twice as dense as SRS 102. For example, in one embodiment wherein the first material of SRS 102 has a density of from about 0.5 to about 1.5 g $cm^{-3}$, the second material of SRS ring 104 may have a density of from about 2 to about 3 g $cm^{-3}$. Representatively, SRS ring 104 may be made of an alloy material, more specifically an aluminum alloy material. In one embodiment, SRS ring 104 may be a substantially planar, ring shaped structure integrally formed from a single material, such as an alloy material.

A suitable third material for suspension member 106 may include, but is not limited to a material that is less stiff than SRS ring 104 and, in some cases, SRS 102. For example, a suitable third material may be a very compliant material having a relatively low Young's modulus (e.g. a lower Young's modulus than SRS ring 104 and SRS 102). A representative very compliant material having a relatively low Young's modulus may include, but is not limited to, a polymer material such as polyurethane (PU). In one embodiment, suspension member 106 may be integrally formed from a single material, such as a polymer material. Suspension member 106 may have a substantially low profile arcuate shape in the z-height direction.

In still further embodiments, it is contemplated that in addition to, or instead of, using a different material to make SRS ring 104 stiffer than SRS 102 and suspension member 106, SRS ring 104 may be thicker (along the z-axis) than SRS 102, and in some cases, suspension member 106. In addition, it is to be understood that a width of SRS ring 104 is, in one embodiment, less than that of SRS 102 and, in some cases, suspension member 106 such that it does not substantially impact a sound radiating surface area of SRS 102. In other words, the SRS ring 104 does not extend into the sound radiating surface area of SRS 102. Rather, SRS ring 104 is positioned around the edges of SRS 102 (instead of a face of the SRS 102) and extends beyond the outer edge 108 of SRS 102. Since SRS ring 104 extends radially outward from SRS 102, as opposed to being positioned along the face of SRS 102, it does not substantially increase the mass of the sound radiating surface area that must be moved to generate sound using SRS 102.

SRS 102, and in turn SRS ring 104 and suspension member 106, may be any shape and size suitable for generating sound pressure waves when integrated within a driver. For example, in one embodiment, each of SRS 102, SRS ring 104 and suspension member 106 may have a substantially circular profile. It is contemplated, however, that in other embodiments, SRS 102, SRS ring 104 and suspension member 106 may have other shapes and sizes, for example, a square, rectangular or elliptical shaped profile.

Figure 2:
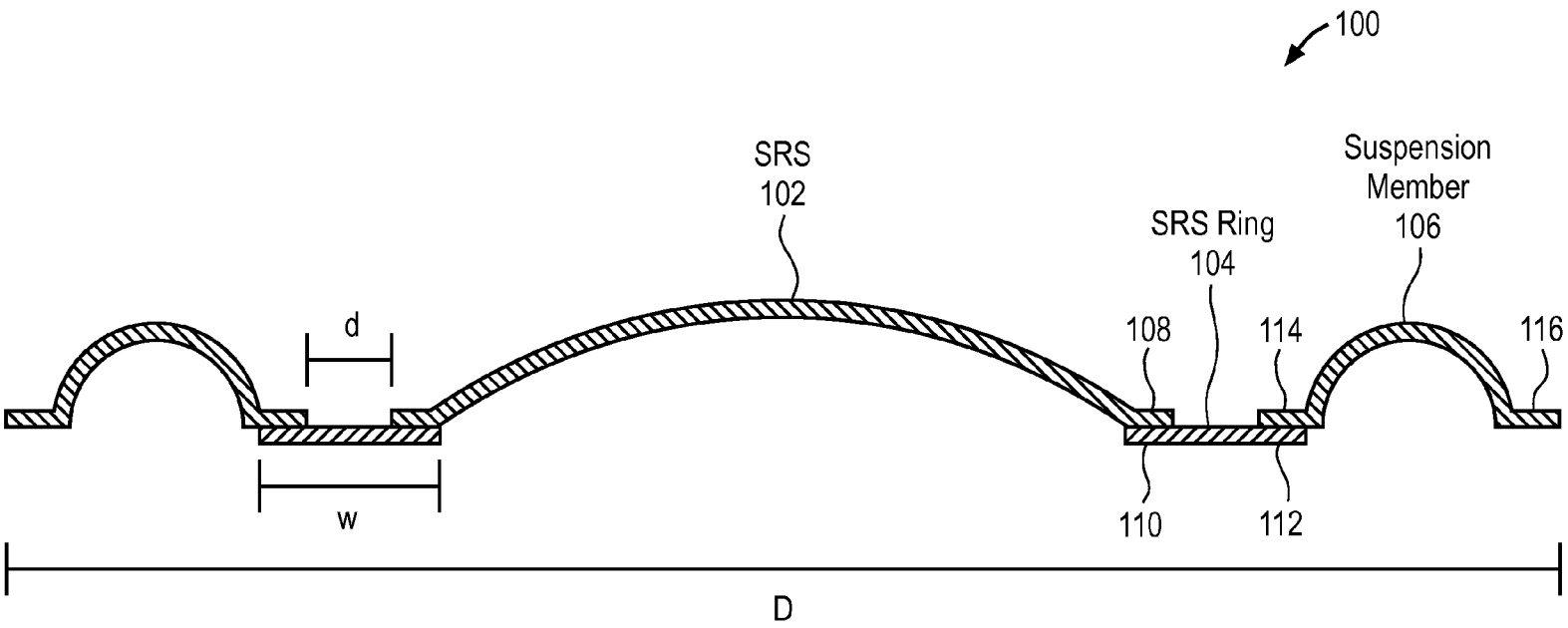
FIG. 2 illustrates a cross sectional side view along line A-A' of the membrane of FIG. 1.

FIG. 2 illustrates a cross sectional side view along line A-A' of the membrane of FIG. 1. From this view, it can be seen that in some embodiments, SRS 102 may have a low profile dome shape. In addition, it can be seen that inner edge 110 of SRS ring 104 is directly connected to the outer edge 108 of SRS and outer edge 112 of SRS ring 104 is directly connected to inner edge 114 of suspension member 106. For example, in one embodiment, a top face portion of inner edge 110 and outer edge 112 of SRS ring 104 may be glued to a bottom face of outer edge 108 of SRS 102 and inner edge 114 of suspension member 106, respectively. Thus, SRS ring 104 separates SRS 102 from suspension member 106 in a radial direction a distance (d) such that SRS 102 does not contact suspension member 106. SRS ring 104 may be a substantially planar structure such that adjoining edges of the SRS 102 and the suspension member 106, namely edges 108 and 114, are substantially coplanar with one another, and/or parallel to the SRS ring 104. In this aspect, SRS ring 104 does not impact a z-height of membrane 100.

In addition, an overall width (w) of SRS ring 104 may be less than that of SRS 102 and suspension member 106 such that it does not substantially increase an overall width of membrane 100 or occupy a substantial portion of the sound radiating surface area of SRS 102, the sound radiating surface area being the dome shaped area of SRS 102 which vibrates in response to an electrical input to output sound waves. In this aspect, membrane 100 provides the advantage of having a large sound radiating surface area while maintaining a relatively small (e.g. narrow) suspension system (e.g. SRS ring 104 and suspension member 106).

A diameter (D) of membrane 100 is further illustrated in FIG. 2. In some embodiments, for example, where the diameter (D) is about 14 mm (14e−3 m), the local stiffening caused by SRS ring 104 as previously discussed, results in an increase or improved breaking mode frequency (f) of at least 4 kHz, or at least 14 kHz. Said another way, where the increase or improvement in breaking mode frequency is represented by f/D, an improvement or increase in breaking mode frequency may be present where f/D is at least 0.2e6 [1/(s*m)] or at least 1e6 [1/(s*m)].

Figure 3:
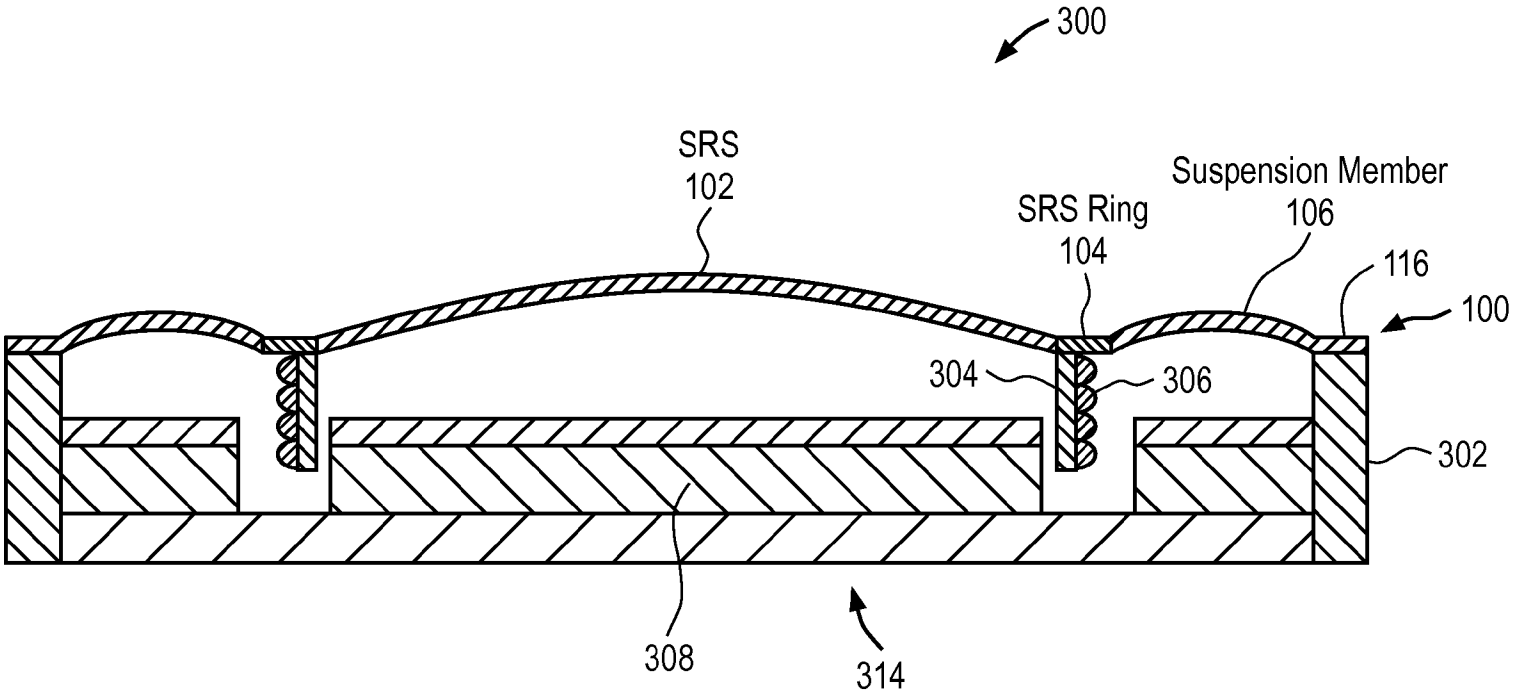
FIG. 3 illustrates a cross sectional side view of the membrane of FIG. 1 integrated within a driver.

FIG. 3 illustrates a cross sectional side view of the membrane of FIG. 1 integrated within a driver. Driver 300 may be any type of electric-to-acoustic transducer which uses a pressure sensitive diaphragm and circuitry to produce a sound in response to an electrical audio signal input (e.g., a loudspeaker). Representatively, membrane 100, which includes SRS 102, SRS ring 104 and suspension member 106 as described in reference to FIG. 1 and FIG. 2, may be integrated within driver 300 to produce a sound. The electrical audio signal may be a music signal input to driver 300 by a sound source. The sound source may be any type of audio device capable of outputting an audio signal, for example, an audio electronic device such as a portable music player, home stereo system or home theater system capable of outputting an audio signal. Driver 300 may be integrated within headphones, intra-canal earphones, inter-concha ear phones or the like.

Representatively, the outer edge of suspension member 106 may be attached to frame 302 to suspend membrane 100 within driver 300. Frame 302 may be part of a driver enclosure or box whose height (or rise) and speaker back volume (also referred to as an acoustic chamber) are considered to be relatively small. For example, the enclosure height or rise may be in the range of about 8.5 millimeters (mm) to about 10 mm. The concepts described here, however, need not be limited to driver enclosures whose rises are within these ranges.

Driver 300 may include magnet assembly 314 positioned along a face of membrane 100. Magnet assembly 314 may define a gap within which a portion of coil 306 (also referred to as a voice coil) and the associated former 304, used to support voice coil 306, may be positioned. The former 304 and/or coil 306 may be attached to a face or side of SRS ring 104 facing magnet assembly 314.

Coil 306, which is affixed to the former 304, may be positioned around center magnet piece 308. It is noted that although former 304 is illustrated, former 304 is optional and may be omitted in some embodiments. Coil 306 may be a pre-wound coil assembly (which includes the wire coil held in its intended position by a lacquer or other adhesive material), which may be bonded directly to former 304, for example to the outer surface wall of the former. In other embodiments, former 304 may be omitted and coil 306 may be attached directly to a surface of SRS ring 104.

Although not shown, coil 306 may have electrical connections to a pair of terminals through which an input audio signal is received, in response to which coil 306 produces a changing magnetic field that interacts with the magnetic field produced by magnet assembly 314 for providing a driving mechanism for driver 300.

As previously discussed, SRS 102 may be coupled to frame 302 by way of suspension member 106. Suspension member 106 allows substantially vertical movement of SRS 102, that is in a substantially up and down direction or also referred to as a forward-backward direction, relative to fixed frame 302. Suspension member 106 may be any compliant material, such as those previously discussed, that is sufficiently flexible to allow movement of SRS 102 in order to produce acoustic or sound waves. The SRS 102 may be more rigid or less flexible, to be more efficient in producing high frequency acoustic waves. In one instance, suspension member 106 is a single-piece flexible membrane, and SRS 102 includes a rigid plate or dome that may be attached to suspension member 106 by SRS ring 104 as previously discussed. This may be done by directly gluing SRS 102, SRS ring 104 and suspension member 106 together at their respective edges and/or faces. In addition to allowing for axial movement of SRS 102, suspension member 106 may also serve to maintain SRS 102 in substantial alignment relative to a center vertical axis of former 304 during operation of driver 300. This alignment also serves to prevent a moving coil from getting snagged by the walls of the magnet system.

Former 304 may have a typical, generally cylindrical or ring like structure around which a voice coil can be wound.

Alternatively, former 304 may be a flat plate with a central opening therein which extends substantially horizontally outward of a peripheral portion of SRS 102. Former 304 may be made from any suitably lightweight yet rigid material, so as to keep the weight of the suspended combination with membrane 100 to a minimum, for greater performance and efficiency. An example material is an aluminum alloy. Other suitable materials include titanium and ceramic, both of which may be made sufficiently lightweight yet rigid.

Figure 4:
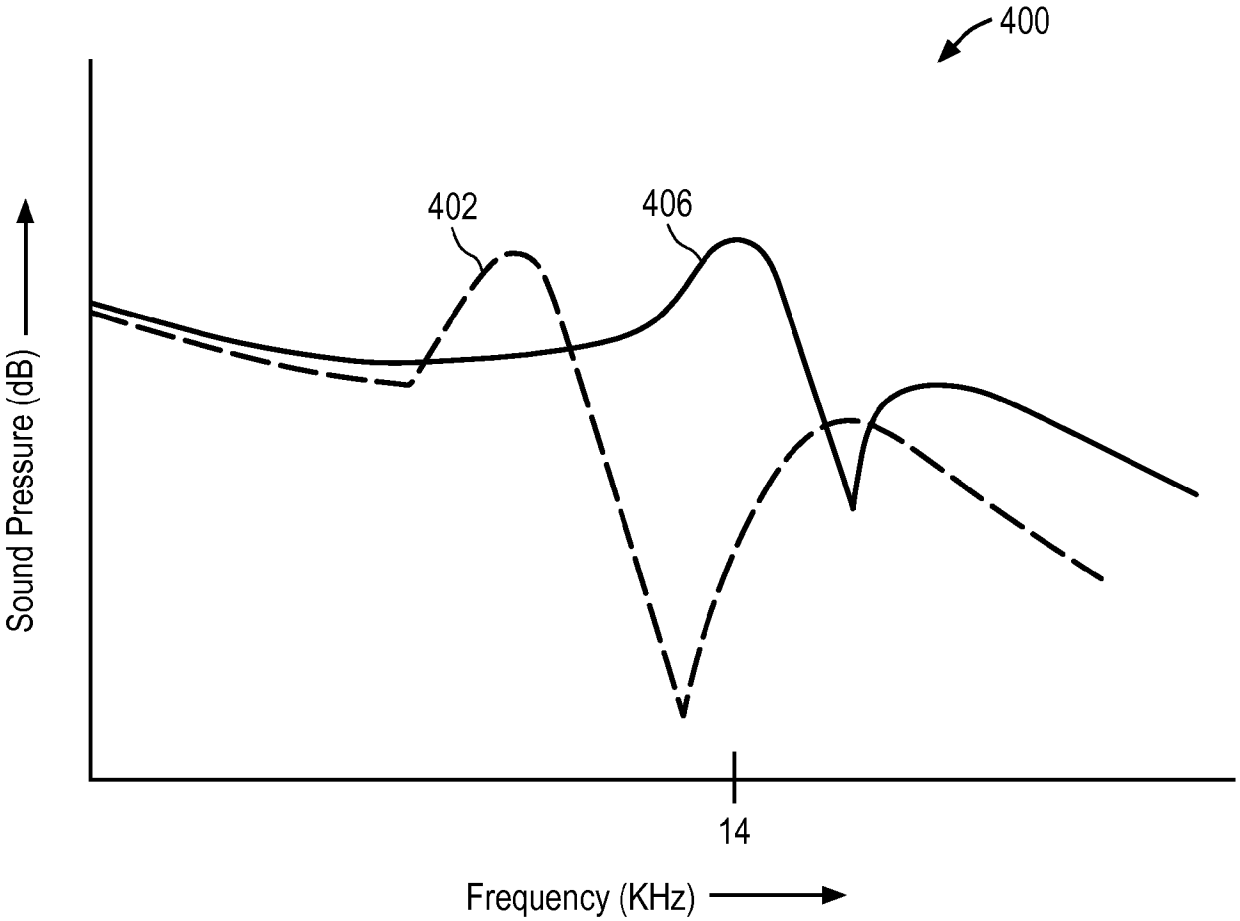
FIG. 4 illustrates frequency response curves for comparison between a driver having a membrane as disclosed herein and a driver without the membrane disclosed herein.

FIG. 4 illustrates frequency response curves for comparison between a driver having a membrane as disclosed herein and a driver without the membrane disclosed herein. In particular, frequency response chart 400 includes dashed line 402 illustrating a frequency response curve for a driver having a membrane without a locally stiffened region as disclosed herein. As can be seen from dashed line 402, a substantial drop in sound pressure occurs at a frequency which is less than 14 kHz (i.e. the breaking mode frequency), for example, less than 4 kHz. The response curve of a driver having a membrane with the stiffening SRS ring as disclosed herein is illustrated by the solid line 406. The response curve formed by solid line 406 is normal within the working range of the driver (e.g. a frequency range of from about 4 kHz to about 14 kHz) and experiences a slight dip in sound pressure at a frequency (i.e. the breaking mode frequency) outside of the working range. Thus, the breaking mode frequency of the driver is increased.

Figure 5:
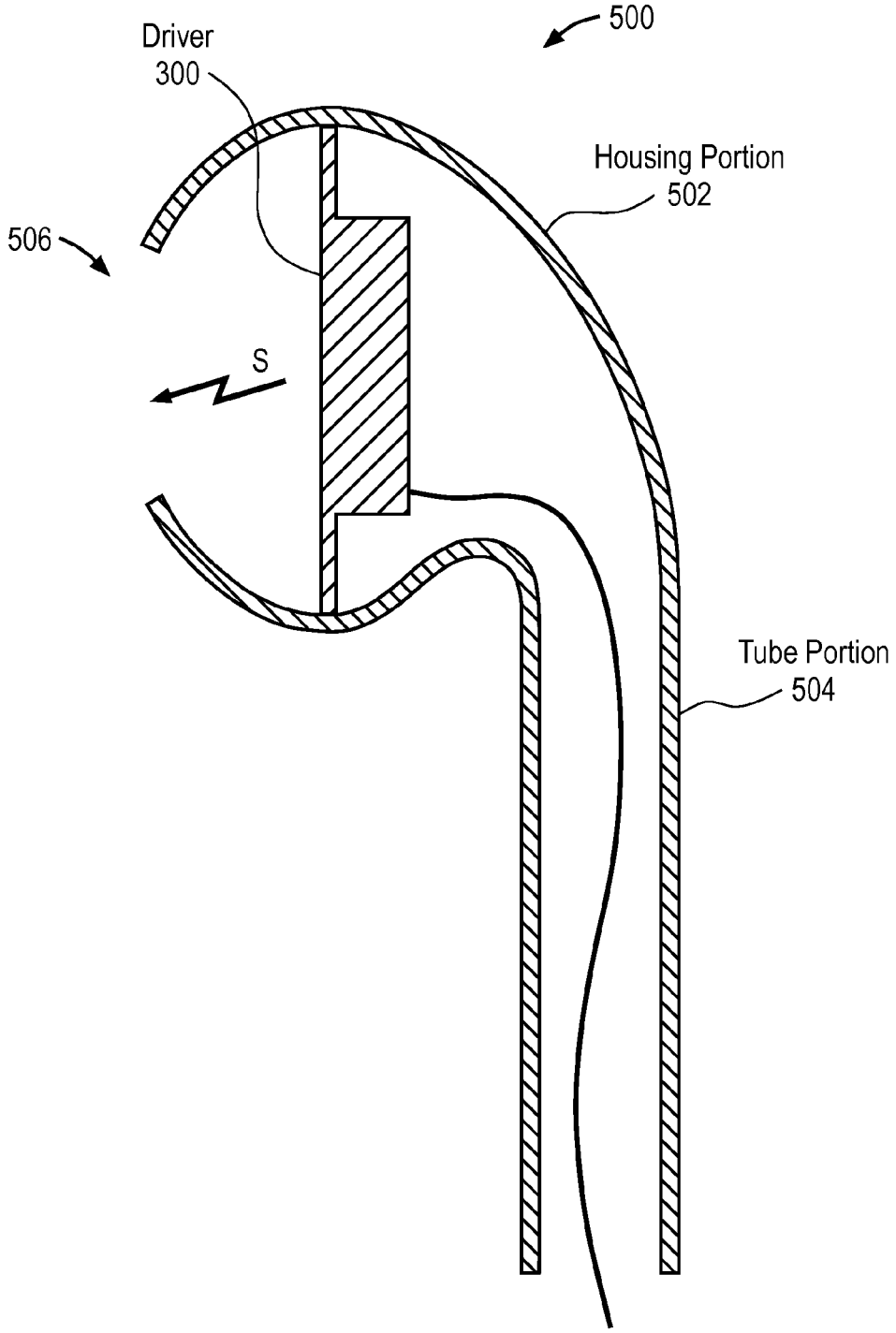
FIG. 5 illustrates one embodiment of an electronic device in which a membrane as disclosed herein may be implemented.

FIG. 5 illustrates one embodiment of an electronic device in which a membrane as disclosed herein may be implemented. Electronic device 500 may be, for example, an intercanal earphone or intra-concha earphone dimensioned to fit within an ear of a user. In this aspect, device 500 may include a housing portion 502 dimensioned to fit within the ear of a user and house the driver, for example driver 300 which includes membrane 100 as discussed in reference to FIG. 1-FIG. 4. A tube portion 504 may extend from the housing portion 502 and provide a conduit through which any circuitry (e.g. wires) extending from driver 300 may run. The housing portion 502 may further include a sound output opening 506 through which sound (S) emitted from driver 300 may be output to the user's ear.

Figure 6:
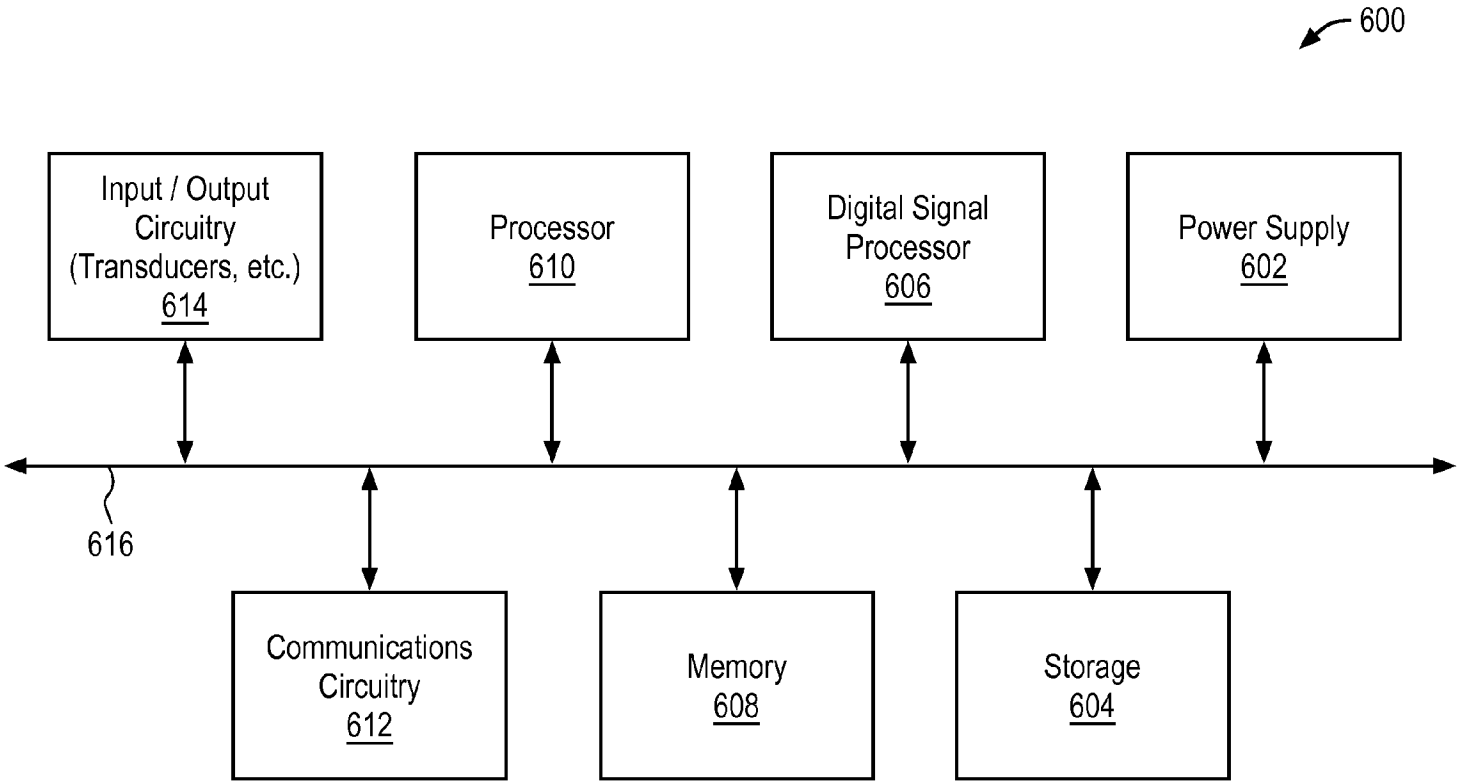
FIG. 6 illustrates a simplified schematic view of one embodiment of an electronic device in which the membrane may be implemented.

FIG. 6 illustrates a simplified schematic view of one embodiment of an electronic device in which a membrane as disclosed herein may be implemented. For example, an intercanal earphone, an intra-concha earphone or headphones as discussed in reference to FIG. 5 are examples of systems that can include some or all of the circuitry illustrated by electronic device 600.

Electronic device 600 can include, for example, power supply 602, storage 604, signal processor 606, memory 608, processor 610, communication circuitry 612, and input/output circuitry 614. In some embodiments, electronic device 600 can include more than one of each component of circuitry, but for the sake of simplicity, only one of each is shown in FIG. 6. In addition, one skilled in the art would appreciate that the functionality of certain components can be combined or omitted and that additional or less components, which are not shown in FIG. 6, can be included in, for example, device 500.

Power supply 602 can provide power to the components of electronic device 600. In some embodiments, power supply 602 can be coupled to a power grid such as, for example, a wall outlet. In some embodiments, power supply 602 can include one or more batteries for providing power to earphones, headphones or other type of electronic device associated with the headphone. As another example, power supply 602 can be configured to generate power from a natural source (e.g., solar power using solar cells).

Storage 604 can include, for example, a hard-drive, flash memory, cache, ROM, and/or RAM. Additionally, storage 604 can be local to and/or remote from electronic device 600. For example, storage 604 can include an integrated storage medium, removable storage medium, storage space on a remote server, wireless storage medium, or any combination thereof. Furthermore, storage 604 can store data such as, for example, system data, user profile data, and any other relevant data.

Signal processor 606 can be, for example a digital signal processor, used for real-time processing of digital signals that are converted from analog signals by, for example, input/output circuitry 614. After processing of the digital signals has been completed, the digital signals could then be converted back into analog signals.

Memory 608 can include any form of temporary memory such as RAM, buffers, and/or cache. Memory 608 can also be used for storing data used to operate electronic device applications (e.g., operation system instructions).

In addition to signal processor 606, electronic device 600 can additionally contain general processor 610. Processor 610 can be capable of interpreting system instructions and processing data. For example, processor 610 can be capable of executing instructions or programs such as system applications, firmware applications, and/or any other application. Additionally, processor 610 has the capability to execute instructions in order to communicate with any or all of the components of electronic device 600.

Communication circuitry 612 may be any suitable communications circuitry operative to initiate a communications request, connect to a communications network, and/or to transmit communications data to one or more servers or devices within the communications network. For example, communications circuitry 612 may support one or more of Wi-Fi (e.g., a 802.11 protocol), Bluetooth®, high frequency systems, infrared, GSM, GSM plus EDGE, CDMA, or any other communication protocol and/or any combination thereof.

Input/output circuitry 614 can convert (and encode/decode, if necessary) analog signals and other signals (e.g., physical contact inputs, physical movements, analog audio signals, etc.) into digital data. Input/output circuitry 614 can also convert digital data into any other type of signal. The digital data can be provided to and received from processor 610, storage 604, memory 608, signal processor 606, or any other component of electronic device 600. Input/output circuitry 614 can be used to interface with any suitable input or output devices, such as, for example, a microphone. Furthermore, electronic device 600 can include specialized input circuitry associated with input devices such as, for example, one or more proximity sensors, accelerometers, etc. Electronic device 600 can also include specialized output circuitry associated with output devices such as, for example, one or more speakers, earphones, etc.

Lastly, bus 616 can provide a data transfer path for transferring data to, from, or between processor 610, storage 604, memory 608, communications circuitry 612, and any other component included in electronic device 600. Although bus 616 is illustrated as a single component in FIG. 6, one skilled in the art would appreciate that electronic device 600 may include one or more bus components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although a three part membrane having a localized stiffening region is primarily disclosed as being implemented within a speaker driver for earphones or headphones, it is contemplated that the three part membrane disclosed herein may be used within any type of driver and integrated within any type of electronic device that could benefit from an increased breaking mode frequency, for example, a notebook, laptop, smartphone or any other type of device which can be used to output sound to a user. The description is thus to be regarded as illustrative instead of limiting.

What is claimed is:

1. A speaker assembly membrane comprising:

a sound radiating surface (SRS) having a first material;

a planar SRS ring positioned concentrically outward from an outer edge of the SRS and having a second material; and a suspension member positioned concentrically outward from an outer edge of the SRS ring and having a third material, and wherein the second material is stiffer than the first material and the third material so as to locally stiffen an area surrounding the SRS and improve a breaking mode frequency of the membrane.

2. The speaker assembly membrane of claim 1 wherein the breaking mode frequency is considered improved where a ratio between a breaking mode frequency (f) of the membrane and a diameter (D) of the membrane is greater than 0.2e6 [1/(s*m)].

3. The speaker assembly membrane of claim 1 wherein the SRS ring comprises an inner edge connected to the outer edge of the SRS and the outer edge of the SRS ring is connected to an inner edge of the suspension member such that the SRS and the suspension member are spaced a distance from one another.

4. The speaker assembly membrane of claim 1 wherein the third material has a lower Young's modulus than the first material and the second material.

5. The speaker assembly membrane of claim 1 wherein the first material, the second material and the third material are different materials.

6. The speaker assembly membrane of claim 1 wherein the second material has a greater material density than the first material and the third material.

7. The speaker assembly membrane of claim 1 wherein the suspension member is dimensioned to suspend the SRS from a frame of the speaker assembly.

8. A speaker assembly membrane comprising:

a diaphragm having a first material density;

a stiffening ring extending radially outward from an outer edge of the diaphragm and having a second material density; and a suspension member extending radially outward from an outer edge of the stiffening ring and having a third material density, wherein the second material density is greater than the first material density and the third material density so as to locally stiffen an area between the diaphragm and the suspension member and increase a breaking mode frequency of the membrane.

9. The speaker assembly membrane of claim 8 wherein the breaking mode frequency is considered increased where a ratio between a breaking mode frequency (f) of the membrane and a diameter (D) of the membrane is at least 1e6 [1/(s*m)].

10. The speaker assembly membrane of claim 8 wherein the first material comprises a polyester material.

11. The speaker assembly membrane of claim 8 wherein the second material comprises an alloy material.

12. The speaker assembly membrane of claim 8 wherein the third material comprises a compliant polymer material.

13. The speaker assembly membrane of claim 8 wherein an inner edge of the stiffening ring is directly connected to the outer edge of the diaphragm and the outer edge of the stiffening ring is directly connected to the suspension member.

14. The speaker assembly membrane of claim 8 wherein the diaphragm comprises a dome shape.

15. A driver comprising:

a frame;

a membrane assembly for radiating sound, the membrane assembly comprising:

a sound radiating surface (SRS);

an SRS ring positioned around an outer edge of the SRS, the SRS ring having an inner edge directly connected to the outer edge of the SRS; and a suspension member positioned around, and directly connected to, an outer edge of the SRS ring, wherein the SRS ring is a single, integrally formed piece that stiffens an area between the outer edge of the SRS and the suspension member; and a voice coil connected to a face of the SRS ring.

16. The driver of claim 15 wherein the driver is a speaker driver.

17. The driver of claim 15 wherein a breaking mode frequency of the driver is above a frequency of 4 kHz.

18. The driver of claim 15 wherein the SRS ring extends beyond a sound radiating region of the SRS.

19. The driver of claim 15 wherein the SRS ring is substantially planar.

* * * * *